US005412915A

United States Patent [19]

Johnson

[11] Patent Number: 5,412,915

[45] Date of Patent: May 9, 1995

[54] DOCK PLANK ASSEMBLY

[76] Inventor: Richard D. Johnson, 19400 Orwell Ave., Marine-On-St. Croix, Minn. 55047

[21] Appl. No.: 5,707

[22] Filed: Jan. 19, 1993

[51] Int. Cl.[6] ..... E01D 19/02; E04D 5/02

[52] U.S. Cl. ..... 52/177; 52/483.1; 52/585.1; 52/772; 14/75; 405/218

[58] Field of Search ..... 52/177, 581, 585, 630, 52/483.1, 772; 14/73, 75, 76; 405/218, 219, 220, 221

[56] References Cited

U.S. PATENT DOCUMENTS

| | | | |
|---|---|---|---|
| 1,900,319 | 3/1933 | Vermeulen | 405/218 |
| 3,046,852 | 7/1962 | Graham | 52/177 |
| 3,143,939 | 8/1961 | Gregoire | 52/177 |
| 3,200,549 | 8/1965 | Cripe | 52/177 |
| 3,555,762 | 7/1968 | Costanzo, Jr. | 52/177 |
| 3,964,221 | 6/1976 | Berquist | 52/177 |
| 3,999,397 | 12/1976 | Albery | 61/48 |
| 4,126,006 | 11/1978 | Lewis | 405/220 |
| 4,266,381 | 5/1981 | Deller | 52/177 |
| 4,349,297 | 9/1982 | Misener | 405/221 |
| 4,386,441 | 6/1983 | Lundholm | 14/27 |
| 4,566,243 | 1/1986 | Dahlin | 52/584 |
| 4,798,029 | 1/1989 | Carlton | 52/177 |
| 4,845,907 | 7/1989 | Meek | 52/177 |
| 4,897,299 | 1/1990 | Kawachie et al. | 52/177 |
| 4,907,387 | 3/1990 | Turnbull | 52/177 |
| 5,009,045 | 4/1991 | Yoder | 52/177 |
| 5,054,253 | 10/1991 | Bedics | 52/177 |

*Primary Examiner*—Michael Safavi
*Attorney, Agent, or Firm*—Jacobson & Johnson

[57] ABSTRACT

An injection-molded plank for forming a dock comprising an elongated member having a generally box-like shape with a top surface for walking on, a front side, and a backside having a plurality of openings therein with the front side having a plurality of spacers mounted on the front side to space one plank from an adjacent plank with a plurality of, pins extending from the front side with the pins having a diameter smaller than mating openings in the backside of the adjacent plank to hold the planks in a shiftable relationship to one another and a separate reinforcing rib secured to the plank with the reinforcing rib having a fastener plate for securing the reinforcing rib to a support member so that the reinforcing rib provides stiffening to the plank and the pin holds adjacent planks in a shiftable relationship to one another while fastener extending through a fastener plate on the reinforcing rib secures the planks to the support member.

8 Claims, 12 Drawing Sheets

DOCK PLANK ASSEMBLY

FIELD OF THE INVENTION

This invention relates generally to dock planks and more specifically, to improvements to dock planks which provide long-lasting, durable dock planks that can be shiftably connected together and secured to a dock stringer with fasteners such as screws or nails.

BACKGROUND OF THE INVENTION

The concept of planks for use in docks is well known in the art. Typically, wooden planks are used for docks because of their low cost and light weight. However, wooden planks have certain disadvantages.

One of the major disadvantages of wooden planks is that the dock is continually exposed to the weather and eventually, the planks rot and must be replaced. Oftentimes, the stringers and support members are sound and do not have to be replaced; however, frequently it is needed to replace the dock planks.

One of the difficulties of making polymer plastic planks, particularly polymer plastic dock planks, is that, in order to make the planks sufficiently strong, they become either too massive and too expensive for use as a dock plank or they become difficult to fabricate.

The present invention provides both a process and method for making a dock plank which has a general rectangular, open-box shape and which is reinforced with a separate reinforcing rib attached to one side of the plank. The reinforced dock plank can be attached directly to the support members of the dock and secured thereto by fasteners located on the reinforcing rib thereby providing both reinforcement to the plastic dock plank and, simultaneously, providing means for further securing a plank to the dock and for securing the plank to an adjacent dock plank.

DESCRIPTION OF THE PRIOR ART

U.S. Pat. No. 4,907,387 shows a U-shaped dock plank having a wood core and an extruded plastic channel extending over the wood core.

U.S. Pat. No. 4,798,029 shows a hold-down clamp for holding adjacent I-beams of a grate proximate one another and in engagement with a support member.

U.S. Pat. No. 4,566,243 shows a plank-grating assembly which can be assembled to other planks without the use of separate fasteners.

U.S. Pat. No. 4,266,381 shows an extruded threadway with a panel having interlock panels for securing to a cross-beam.

U.S. Pat. No. 3,999,397 shows a modular dock system comprised of external aluminum panels.

U.S. Pat. No. 1,900,319 shows a floating dock with dove-tail sections for interlocking to one another.

U.S. Pat. No. 4,386,441 shows a folding dock having wheels mounted in the dock for moving the dock in its folded state.

U.S. Pat. No. 4,126,006 shows a boat-dock assembly with portable sections which are hingedly connected to each other through laterally extending members which laterally engage one another.

U.S. Pat. No. 3,555,762 shows a false floor with interlocking metal sections for locking one side of the floor to an adjacent side.

U.S. Pat. No. 3,143,939 shows a landing mat structure with interlocking members for locking one side of a member to another side of a similar member.

U.S. Pat. No. 3,200,549 shows a cargo-supporting structure with interlocking members.

U.S. Pat. No. 3,046,852 shows a grating having a U-shaped clip for securing adjacent edges of the grating in a side-to-side manner.

U.S. Pat. No. 5,054,253 shows a grating mat assembly with clips for securing adjacent members to one another to provide a grating map.

U.S. Pat. No. 4,845,907 shows a panel module having L-shaped members which lock together to hold one panel proximate to another panel.

U.S. Pat. No. 4,897,299 shows a grating of fiber-reinforced plastic wherein a bolt extends through the gratings to hold adjacent members together.

U.S. Pat. No. 4,349,297 shows a boat dock comprised of plastic resin planks.

U.S. Pat. No. 3,964,221 shows a platform section having interfitting members which can be locked together to form a dock.

U.S. Pat. No. 5,009,045 shows an extended channel-shaped plastic dock section plank having channels thereon for diverting the water away from the top of the plank.

SUMMARY OF THE INVENTION

Figure 1:
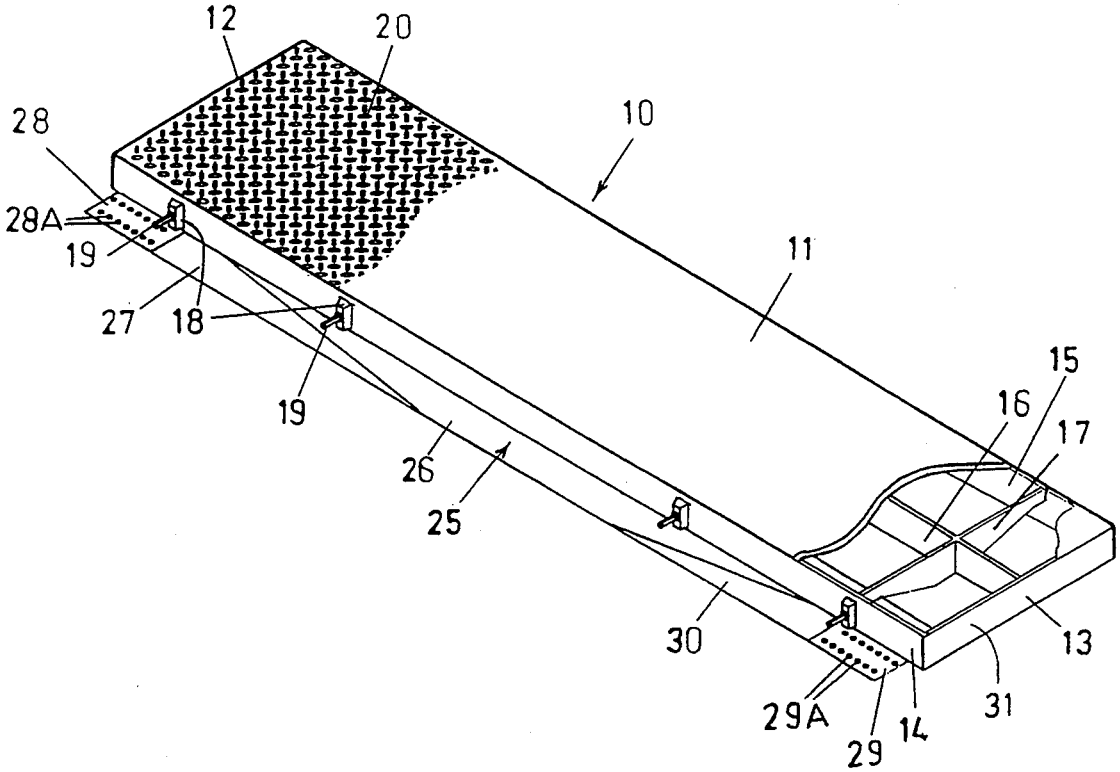
FIG. 1 is a perspective view of my dock plank.

Briefly, the invention comprises an injection-molded plank for forming a dock with the plank comprising an elongated member having a generally box-like shape with a top surface for walking on, a front side, and a backside having a plurality of openings therein. The front side has a plurality of spacers mounted on the front side to space one plank from an adjacent plank. A plurality of pins extend from the front side with the pins having a diameter smaller than mating openings in the backside of the adjacent plank to hold the planks in a shiftable relationship to one another. A separate reinforcing rib secured to the plank has a fastener plate for securing the reinforcing rib to a support member so that the reinforcing rib provides stiffening to the plank. The pin holds adjacent planks in a shiftable relationship to one another while fasteners extending through the fastener plate on the reinforcing rib secures the planks to the support member.

DESCRIPTION OF THE PREFERRED EMBODIMENT

FIGS. 1–4, reference numeral 10, generally identities my injection-molded dock plank, having a general elongated and rectangular shape. Plank 10 has a top surface 11 which together with sides 14 and 15 and ends 12 and 13 define the shape of a box without a cover. Extending lengthwise underneath surface 11 is an integral longitudinal rib 16 and extending cross-wise is an integral lateral rib 17. While only two integral ribs are shown, more or fewer integral ribs could be used.

Ribs 16 and 17 are integrally molded to the sides and undersurface of the dock plank to from a stiffened one-piece dock plank. In the embodiment shown, semicircular protrusions 20 are molded into top surface 11 and extend upward from the surface to provide gripping ridges for engaging a user's foot.

Located on side 14 of plank 10 is a set of spacers 18 and pins 19 which form a spaced lateral shiftable, mechanical connection between adjacent planks. Extending lengthwise along the inside of plank 10 and side 14 is a separate metal one-piece reinforcing rib 25. Reinforcing rib 25 comprises a multi-angled member to provide added stiffness for plank 10 as well as provide means for securing plank 10 to a dock support. Typically rib 25 may be made from corrosion resistant material such as galvanized metal or the like.

Figure 7:
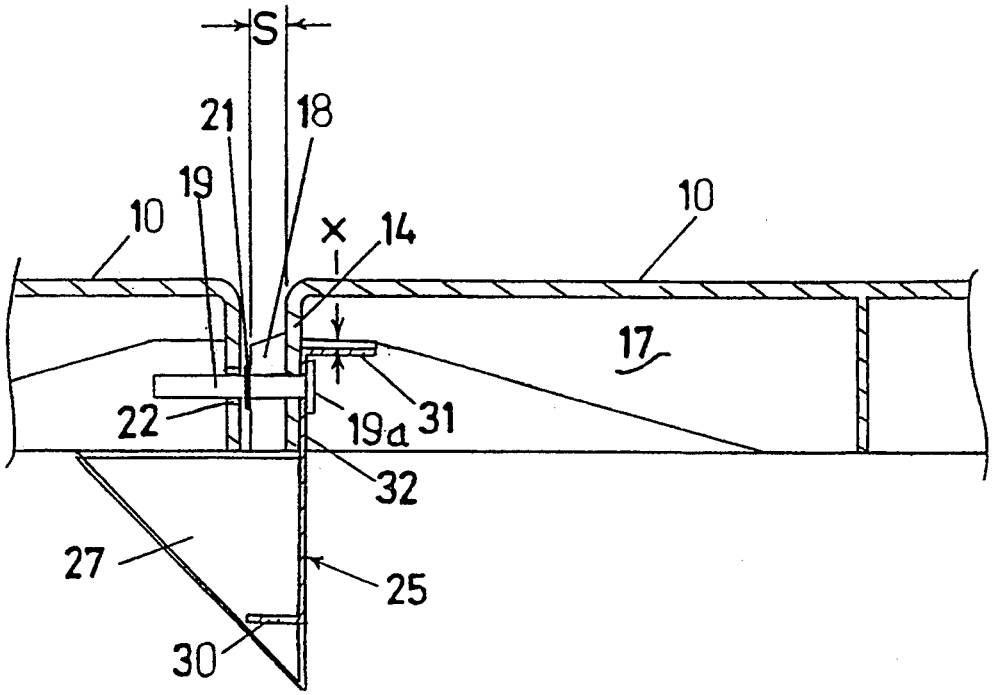
FIG. 7 is a partial cut-away taken along line 7—7 of FIG. 5.

FIGS. 1–4 and FIG. 7 show one-piece reinforcing rib 25 in greater detail. Rib 25 includes a first flat, elongated section 31 extending perpendicular to side 14 (FIG. 1) and a similar flat section 32 (FIG. 7) located at a right angle to section 31 which extends along side 14 of dock plank 10 (FIG. 7). Connected to one end of section 32 is a first triangular shaped wing member 30 (FIG. 7) which extends upward to a rectangular dock fastener, plate 29 (FIG. 1) having a plurality of openings **29*a* therein for securing fastener plate 29 to a dock support. Similarly, connected to the opposite end of section 32 is a second triangular shaped wing member 27 (FIGS. 1 and 7) which extends upward to fastener plate 28 (FIG. 1 ) which has a plurality of openings 28*a* therein for securing fastener plate, 28** to a dock support.

Figure 2:
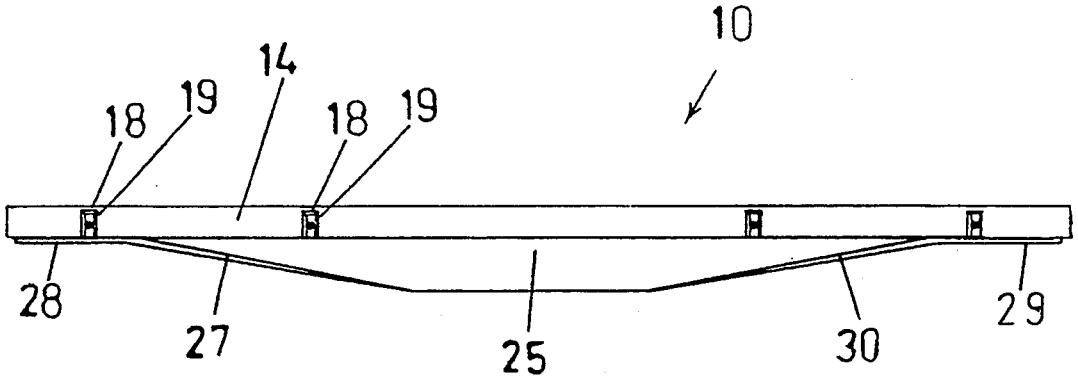
FIG. 2 is a front view of my dock plank of FIG. 1.
Figure 3:
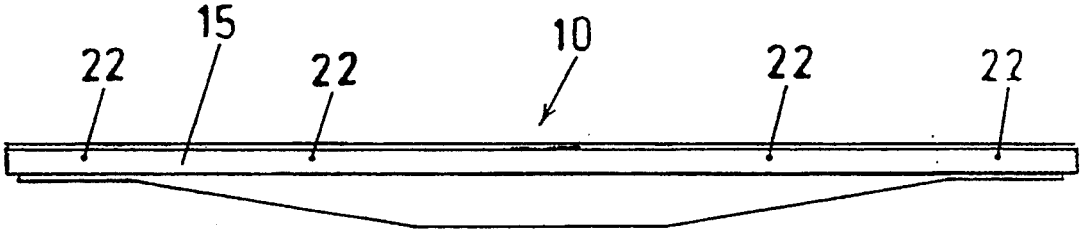
FIG. 3 is a rear view of the dock plank of FIG. 1.
Figure 4:
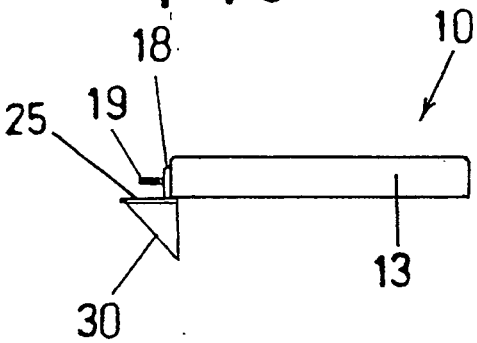
FIG. 4 is an end-view of the dock plank of FIG. 1.

The multi-angled reinforcing rib 25 provides stiffness and support to the dock plank and can best be illustrated by referring to multiple figures. FIG. 2 shows a front view of rib 25; FIG. 3 shows a rear view; FIG. 4 shows an end view; and FIG. 1 shows a perspective view of rib 25 while FIG. 7 shows a cross-sectional view of rib 25. By use of rib 25 as an under attachment allows the molded surfaces of the dock planks to provide the dock wear surface.

Figure 6:
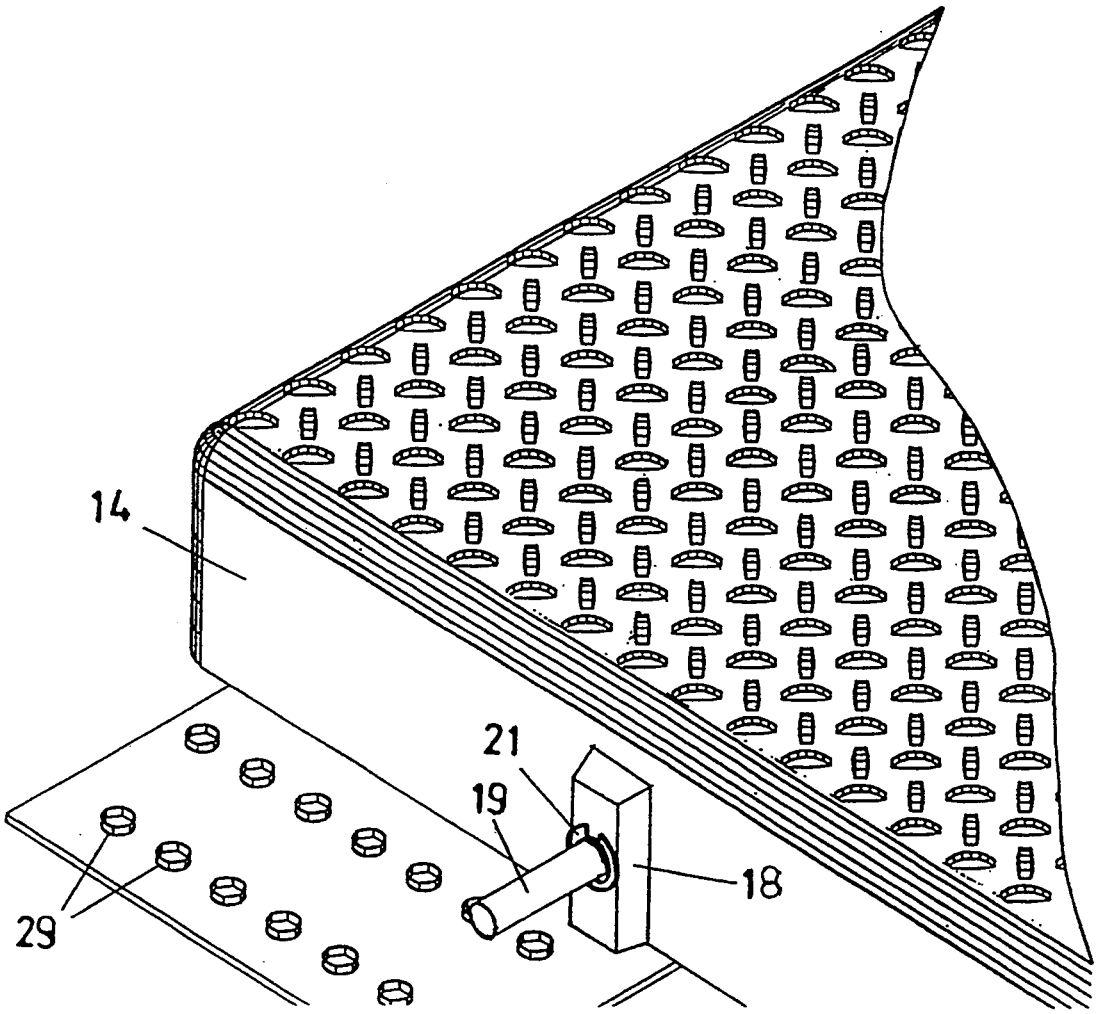
FIG. 6 is a partial enlarged view of the dock plank of FIG. 1 showing the spacer and pin connector.

The spacer and pin mechanism for securing dock plank 10 to an adjacent dock plank in a shiftable relationship is illustrated in FIGS. 1, 6 and 7. Since each of the spacer and pin mechanisms on plank 10 are identical, only one will be described. FIGS. 6 and 7 show spacer 18 extending outward a distance "s" typically ⅜- to ½-inch from side 14. The purpose of the spacer is to prevent the side of an adjacent dock plank from contacting side 14 of the plank to allow water to drain off between adjacent dock planks. Extending through spacer 18 and side 14 is a cylindrical pin 19 having a cylindrical head **19*a* in engagement with section 32 of rib 25 (FIG. 7). A retaining washer 21 (FIG. 6) secures pin 19 to spacer 18. Pin 19 serves two functions. First, it secures reinforcing rib 25 to plank 10, thus stiffening and providing greater rigidity to plank 10. Second, pin 19 extends sufficiently outward from side 14 so that the free end of pin 19 can engage a mating larger opening 22 (FIGS. 3 and 7) in the backside of an adjacent dock plank to thereby hold two planks 10** proximate one another in a shiftable relationship.

Figure 5:
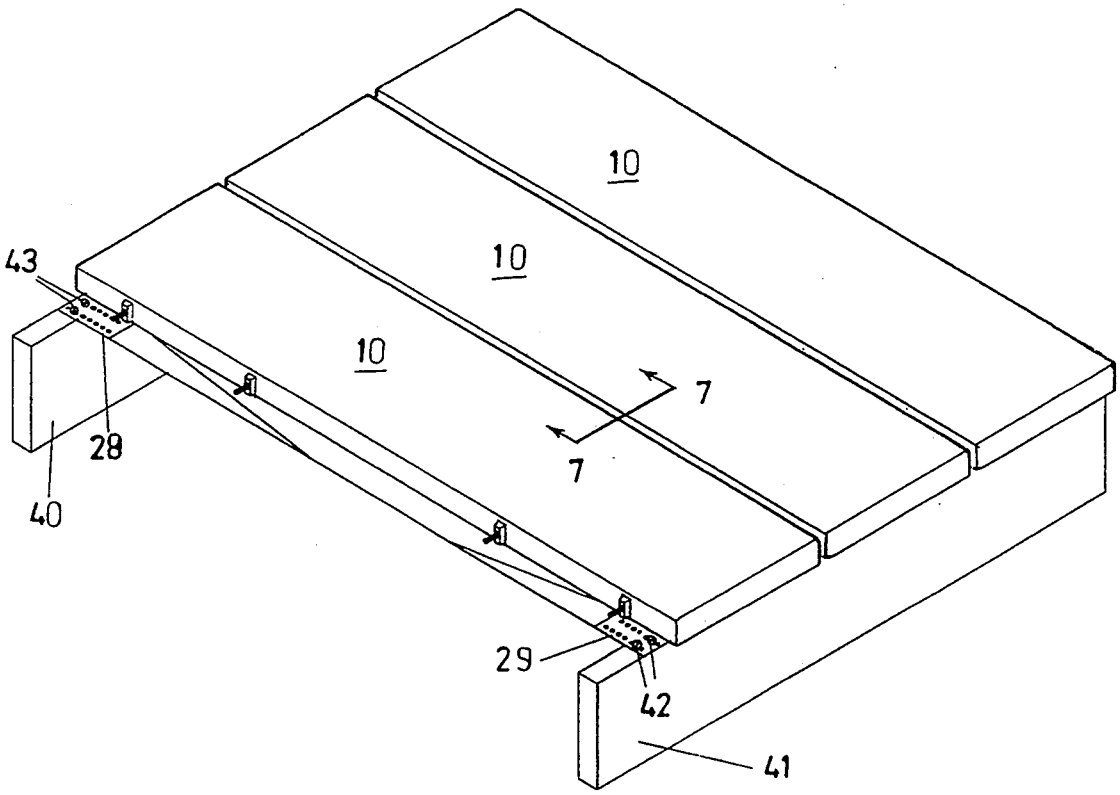
FIG. 5 is a perspective view of my dock planks located on dock supports.
Figure 8:
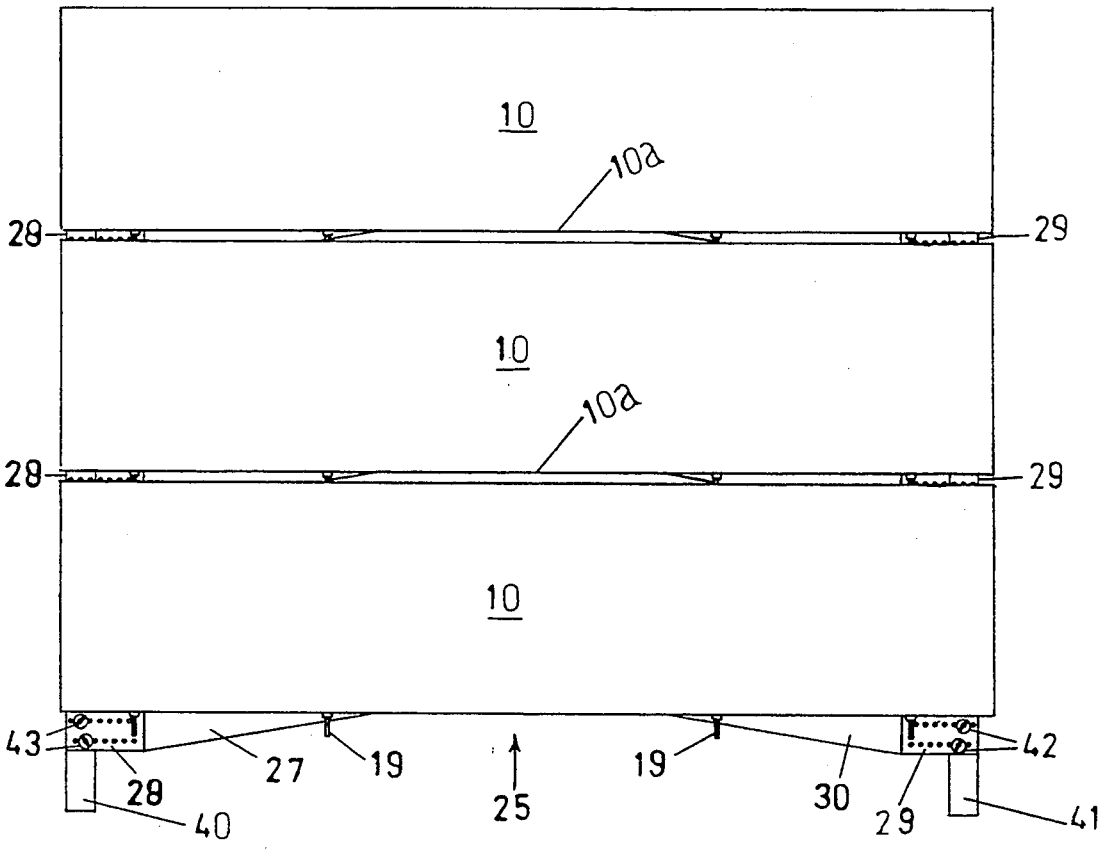
FIG. 8 is a top view of a portion of a dock.

To illustrate the assembly of dock planks 10 to produce a dock, refer to FIGS. 5 and 8 which show a portion of a dock combining three identical dock planks 10 which are secured to parallel spaced dock support stringers 40 and 41. A first pair of fasteners comprising screws 42 extends through holes **29*a* and rib fastener plate 29 to secure rib fastener plate 29 and dock plank 10 thereto. Similarly, a second pair of fasteners comprising screws 43 extends through holes 28*a* to secure rib fastener plate 28 to support member 40. Fastening reinforcing rib 25 to both supports 40 and 41 holds one side of plank 10 and consequently pins 19 in a fixed lateral extended position so that a plurality of dock planks can be laterally and shiftably secured to each other to prevent lateral movement of the dock planks with respect to each other. FIGS. 5 and 8 illustrate three dock planks with each of the reinforcing ribs 25 of each plank secured to support members 40 and 41 through identical fastener plates 28 and 29. Thus, the present invention allows one to build a dock one plank at a time by securing reinforcing rib 25 to the stringer and then inserting the mating openings in the backside of another plank onto the cylindrical pins in the second plank to thereby laterally secure the opposite edge of the plank. The top view shown in FIG. 8 reveals that gaps 10*a* extend between adjacent planks to direct water around each plank. In addition, the wing members 27 and 30** direct water away from the supports to the inside of the dock.

FIG. 7 shows in greater detail the lateral restraining but shiftable relation between adjacent planks 10. Opening 22 is larger than the diameter of pin 19 to permit ease in assembly as well as to allow a small amount of flexing or shifting between individual planks to thereby distribute stresses on the dock over a greater area. The larger the opening the more that the planks can shift with respect to one another. In most instances the diameter of opening 22 is about twice the diameter of the pin. If greater lateral shiftably is desired the mating opening can be made with an elongated opening having the longer dimension extending parallel to rib 25. In addition, rib section 31 is spaced from integral rib 17 (FIG. 7) a distance denoted by x (typically ⅛-inch) to permit flexing of plank 10 without having section 31 contact rib 17 and thus create a pressure point on rib 25.

Figure 9:
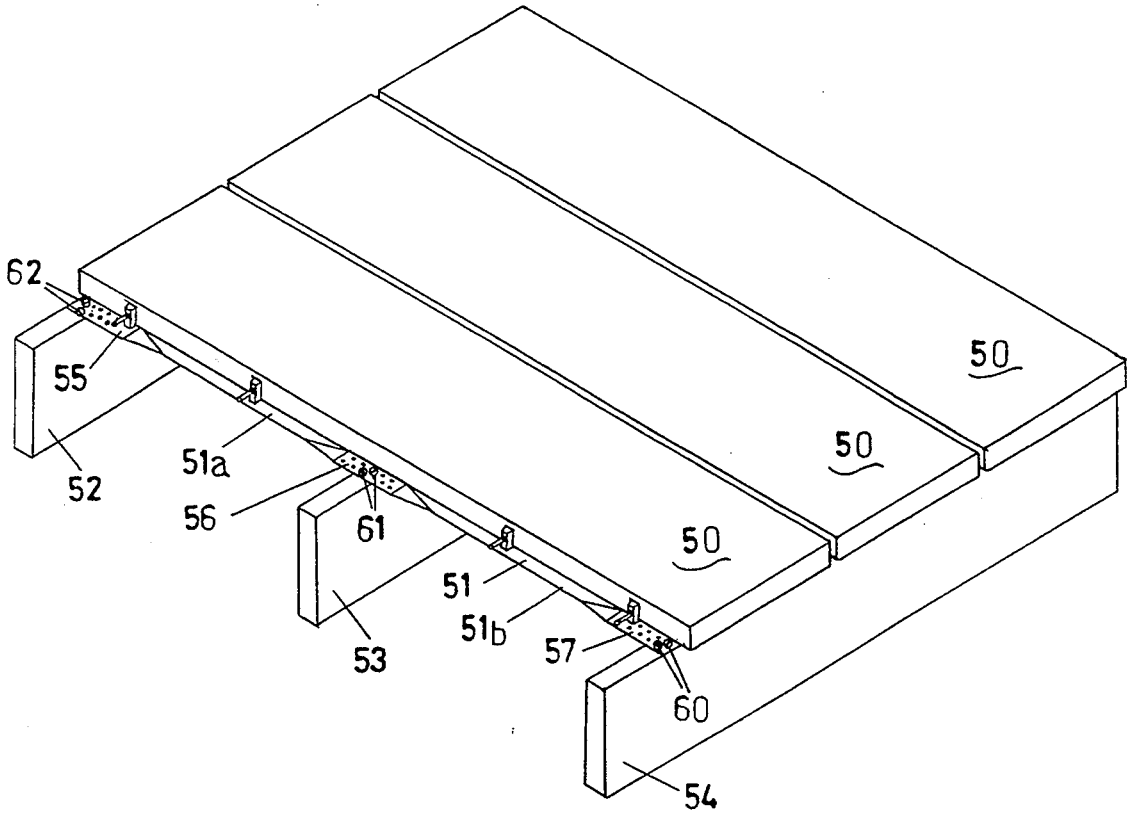
FIG. 9 is a perspective view of an alternate dock plank.
Figure 10:
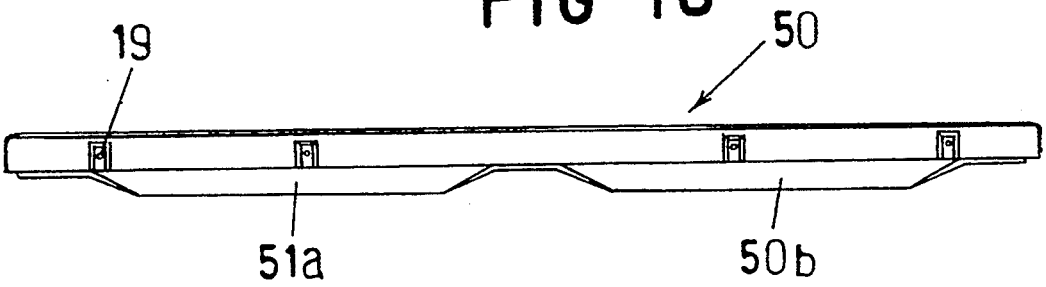
FIG. 10 is a front view of the dock plank of FIG. 9.
Figure 11:
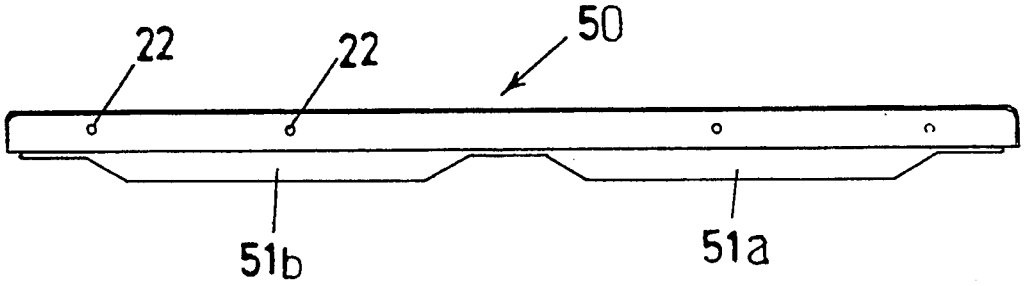
FIG. 11 is a rear-view of the dock plank of FIG. 9.
Figure 12:
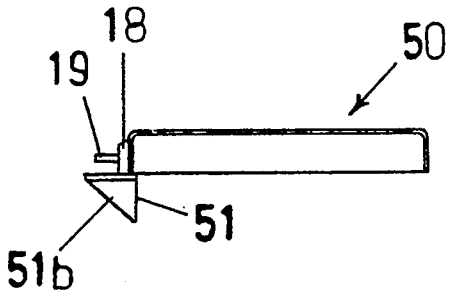
FIG. 12 is a side-view of the dock plank of FIG. 9.

While the invention is shown and described for use with two parallelly spaced dock stringers, my dock planks can also be used with multiple support members 52, 53 and 54 (FIG. 9). In this embodiment, three fastening plates 55, 56 and 57 are used to secure the dock plank 50 by use of fasteners such as screws 60, 61 and 62.

In the embodiment of FIGS. 9–12, two vertical portions of rib **51*b* extend downward; that is, section 51*a* extends downward between supports 52 and 53 to provide stiffening for the portion of plank 50 located between support members 52 and 53** and similarly, section 51*b* extends downward between support members 53 and 54 to provide further stiffening for the portion of plank 50 located between support members 53 and 54.

Figure 13:
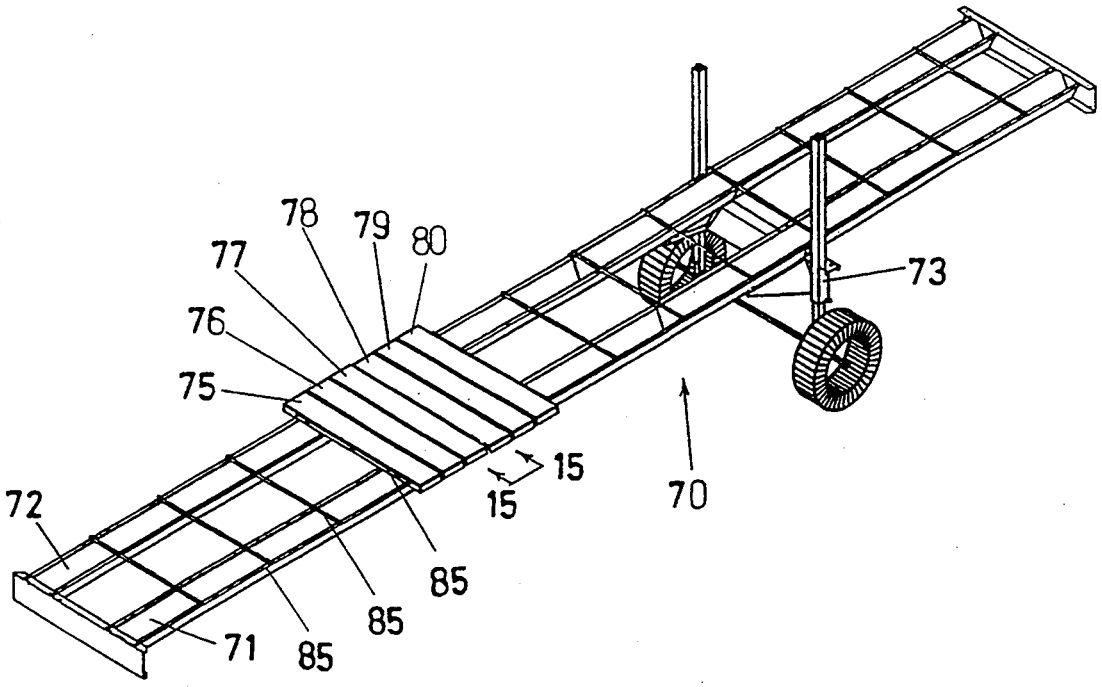
FIG. 13 is a perspective view of a V-channel dock.
Figure 14:
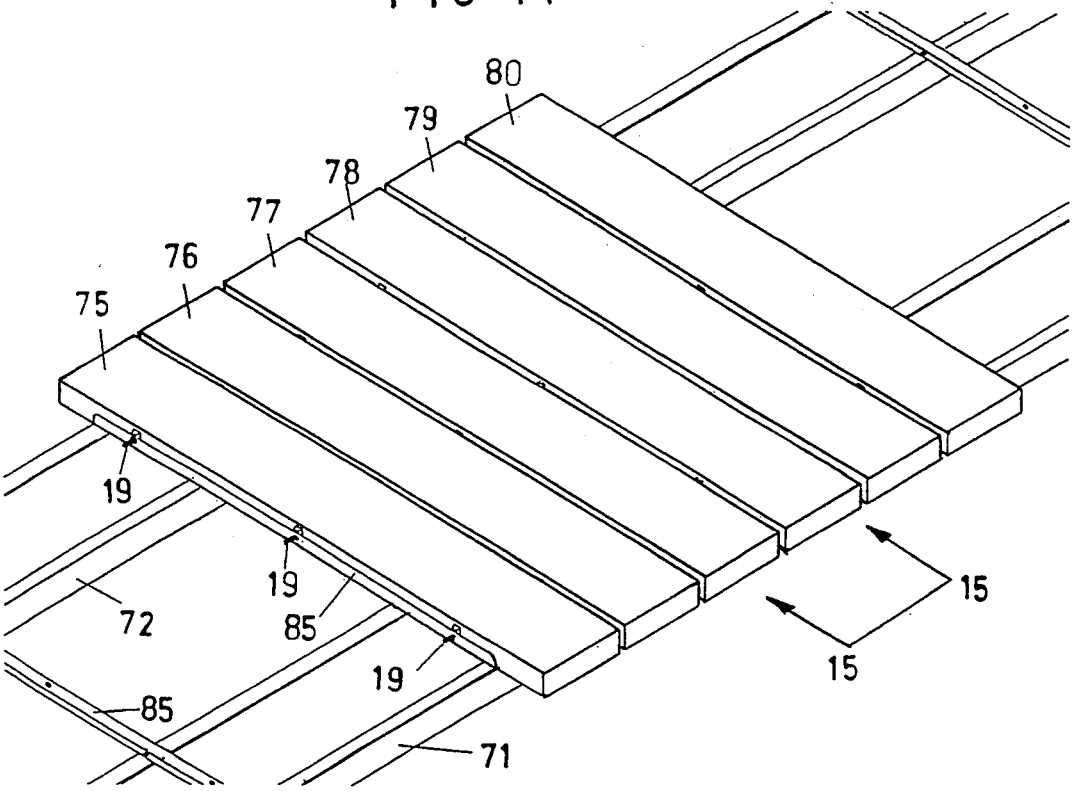
FIG. 14 is an enlarged view of the dock section of FIG. 13.
Figure 15:
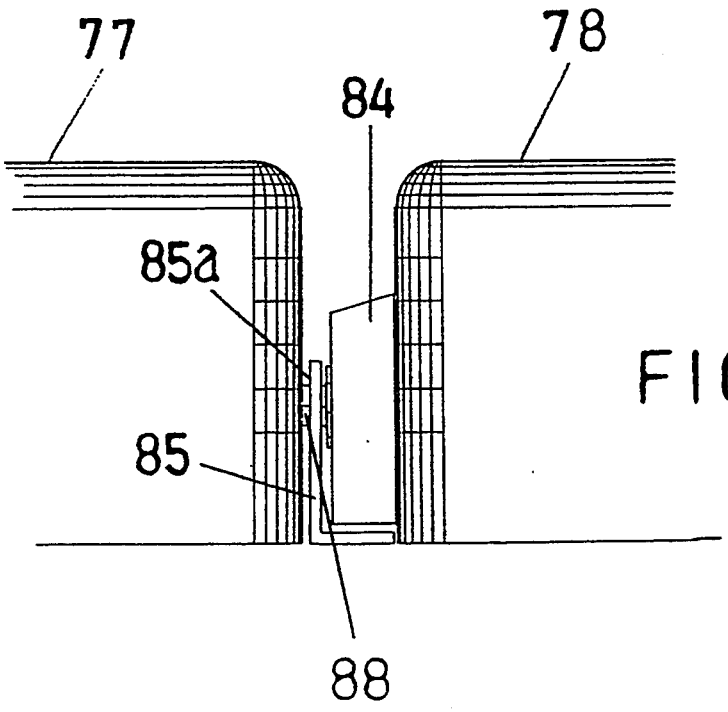
FIG. 15 is a view taken along line 15—15 of FIG. 14.

FIGS. 13, 14 and 15 show an alternate embodiment of my invention for use in retrofitting V-channel docks with my dock planks. FIG. 13 reference numeral 70 generally identifies a dock 70 having a first metal V-channel support member 71 and a second metal V-channel support member 72 which are supported by a wheeled frame 73. Located on top of V-channels 71 and 72 and secured thereto in groups of three or more are dock planks 75, 76, 77, 78, 79 and 80. Dock planks 75–80 are identical to dock plank 10 (FIG. 1) except that dock planks 75–80 do not contain metal reinforcing ribs secured to the individual planks.

Dock planks 75 and 77 are connected to dock plank 76 through the use of bolts (FIG. 16) rather than cylindrical pins thus holding the dock planks of each section in a non shiftable relationship with respect to one another. Use of bolts allows one to form dock planks 75, 76 and 77 into an integral dock section for mounting between cross channels 85 (FIG. 13) located on V-channels 71 and 72. While each of the planks of each section is fixedly held with respect to the central plank the dock sections are held in a shiftable relationship through pins and openings in an adjacent plank.

FIG. 15 shows an end-view of planks 77 and 78 illustrating mounting of the dock sections containing planks 75, 76 and 77 in a shiftable relationship to dock section containing planks 78, 79 and 80 through support cross channel 85. Pin 88 extends frown spacer 84 through an enlarged opening 85*a* in cross-channel 85 which is secured to V-channels 71 and 72 through fasteners (not shown) and into an enlarged opening in plank 77. Consequently, the left side of plank 78 is laterally and longitudinally secured in a shiftable relationship against cross channel 85 by pin 88 engaging cross-channel 85 and, likewise, the plank 77 is secured in a shiftable relationship against cross-channel 85 by the free end of pin 88 which engages an enlarged mating opening in the backside of plank 77 (not shown).

Figure 16:
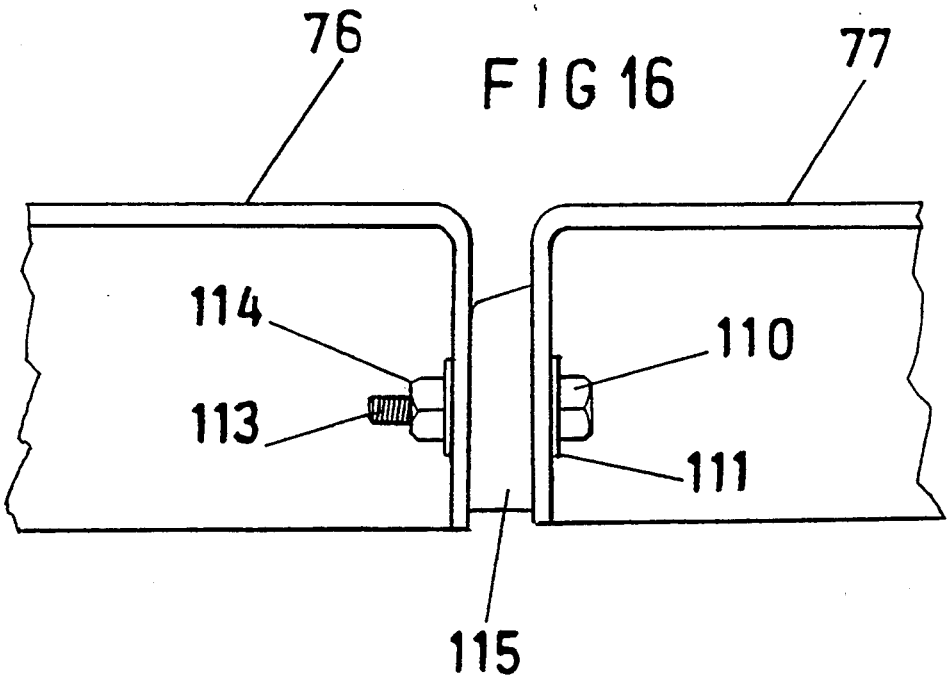
FIG. 16 is an enlarged partial sectional view showing the connecting link between individual planks in a dock section.

FIG. 16 shows plank 76 held proximate plank 77 by a bolt 110 having a threaded section extending through washer 111, spacer 115 and washer 112. A nut 114 on section 113 secures plank 76 to plank 77 to create a modular section.

Figure 17:
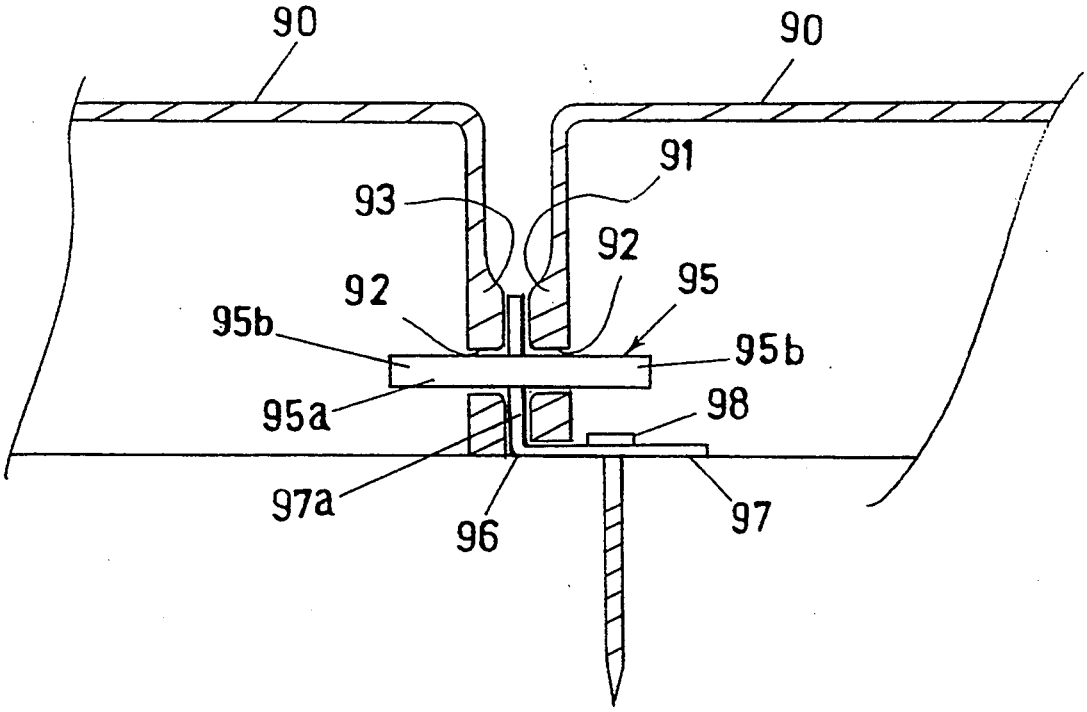
FIG. 17 is an alternate embodiment of a fastener for dock planks.

FIG. 17 shows an alternate fastening member 95 for shiftably securing adjacent planks to a dock support member. Member 95 comprises an angle member 96 having a first member 97 secured to a dock support member by nail 98. The right-angled member 97*a* connected to member 97 includes a cylindrical cross pin 95*a* having a first end 95*b* extending through enlarged opening 92' in spacer 93 of plank 90'. Similarly, end 95*b'* extends through enlarged opening 92 in spacer 91 to hold planks 90 and 90' in lateral shiftable relationship to one another.

Figure 18:
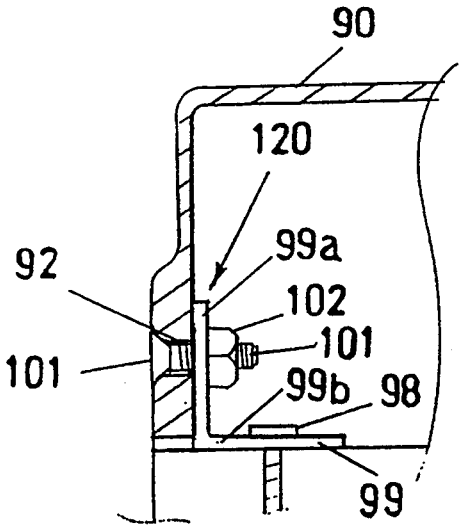
FIG. 18 shows a fastener for connecting the end dock plank.

FIG. 18 shows how end plank 90 is secured to a dock support member by end plank fastener 120. End plank fastener 120 includes an angle member comprised of member 99*a* and 99*b* with nail 98 extending through opening 99 to hold fastener 120 on dock support member. A bolt 100 extends through opening 92 in plank 90 and member 99*a* where it is secured to by nut 102 located on threads 101.

In the preferred embodiment plank 10 is injection molded from polyethylene or polypropylene and the reenforcing rib is made of galvanized metal.

I claim:

1. A dock comprising:

a pair of support members;

a cross channel extending transversely across said pair of support members, said cross channel having a first side and a second side, a first plank having a top surface for walking on, a backside with a plurality of openings therein and a front side, said first plank located on said first side of said cross channel with said backside proximate said first side of said cross channel;

a second plank, said second plank located on said second side of said cross channel, said second plank having a top surface for walking on, a back side with a plurality of openings therein and a front side with a plurality of extension pins extending therefrom, said plurality of extension pins of said second plank having an outside dimension smaller than the interior of the openings in said first plank and extending therethrough to thereby shiftably and laterally restrain said first plank with respect to said second plank;

a third plank having a top surface for walking, said third plank having a front side located proximate said backside of said second plank; and a fastening member engaging said third plank and said second plank to form said second and third planks into a modular section so that the modular section of said second plank and said third plank are held in a shiftable relationship with respect to said first plank.

2. The dock of claim 1 wherein said first plank is a polymer plastic.

3. The dock of claim 1 wherein said fastening member comprises a bolt and a nut with said bolt extending through the backside of the second plank and the front side of the third plank.

4. The dock of claim 1 wherein said third plank includes a spacer for spacing said backside of the second plank from the front side of said third plank.

5. The dock of claim 1 including a fourth plank integrally connected to said first plank to form a further modular dock section.

6. A dock comprising:

a first plank having a top surface for walking on, a backside with a plurality of openings therein and a front side having a plurality of extension pins extending therefrom;

a second plank, said second plank having a top surface for walking on, a back side with a plurality of openings therein and a front side with a plurality of extension pins extending therefrom, said plurality of extension pins of said second plank having an outside dimension smaller than the interior of the openings in said first plank and extending therethrough to thereby shiftably and laterally restrain said first plank with respect to said second plank; and a channel member having two sections at a right angle to one another with one section engaging said extension pins to hold said first plank and said second plank proximate said channel member.

7. The planks of claim 6 wherein said planks are made of polypropelene.

8. The planks of claim 6 wherein said planks are made of polyethylene.

* * * * *